United States Patent [19]

Tanaka et al.

[11] Patent Number: 5,054,391

[45] Date of Patent: Oct. 8, 1991

[54] THERMAL STENCIL SHEET ASSEMBLY WITH STENCIL SHEET TEMPORARILY DETACHABLE FROM FRAME

[75] Inventors: Toshio Tanaka; Noboru Hayama; Satoru Komata; Kazuo Sakamoto, all of Tokyo, Japan

[73] Assignee: Riso Kagaku Corporation, Tokyo, Japan

[21] Appl. No.: 518,406

[22] Filed: May 3, 1990

[30] Foreign Application Priority Data

May 12, 1989 [JP] Japan ..... 1-117434
May 12, 1989 [JP] Japan ..... 1-117435

[51] Int. Cl.[5] ..... B05C 17/08
[52] U.S. Cl. ..... 101/127.1; 101/128.1
[58] Field of Search ..... 101/127, 127.1, 128, 101/128.1, 128.21, 128.4

[56] References Cited

U.S. PATENT DOCUMENTS

| | | | |
|---|---|---|---|
| 2,248,404 | 7/1941 | Elliott | 101/127.1 |
| 3,538,847 | 11/1970 | Heilman | 101/128.21 |
| 3,788,217 | 1/1974 | Rabelow | 101/128.1 |
| 4,128,057 | 12/1978 | Hayama et al. | 101/127 |
| 4,550,660 | 11/1985 | Sato et al. | 101/128.21 |
| 4,664,031 | 5/1987 | McKillip | 101/127.1 |
| 4,896,597 | 1/1990 | Hayata et al. | 101/128.21 |

FOREIGN PATENT DOCUMENTS

| | | | |
|---|---|---|---|
| 51-132007 | 10/1976 | Japan . | |
| 54-33117 | 3/1979 | Japan . | |
| 54-23601 | 8/1979 | Japan . | |
| 57-15814 | 4/1982 | Japan . | |
| 60-13664 | 1/1985 | Japan . | |
| 180892 | 9/1985 | Japan | 101/127 |
| 63-56450 | 3/1988 | Japan . | |

*Primary Examiner*—Edgar S. Burr
*Assistant Examiner*—Ren Yan
*Attorney, Agent, or Firm*—Stevens, Davis, Miller & Mosher

[57] ABSTRACT

A thermal stencil sheet assembly of the type having an annular frame made of a cardboard and a thermal stencil sheet attached to one face of the frame as fixed thereto along an entire peripheral portion thereof with or without an ink pressing sheet made of an ink impermeable sheet attached to another face of the frame, wherein the frame is assembled of a first frame element made of a relatively thin sheet material and a second frame element made of a cardboard, the two frame elements being detachably and reattachably bound together by a slippery surface provided on the first frame element being attached to a layer of a sticky binding material provided on the second frame element.

4 Claims, 2 Drawing Sheets

THERMAL STENCIL SHEET ASSEMBLY WITH STENCIL SHEET TEMPORARILY DETACHABLE FROM FRAME

BACKGROUND OF THE INVENTION

1. Field of the Invention

The present invention relates to the art of stencil printing, and, more particularly, a thermal stencil sheet assembly for use as a stencil plate for conducting the stencil printing by employing a thermal stencil sheet adapted to be thermally perforated.

2. Description of the Prior Art

In the art of thermal stencil printing of perforating a very thin thermo-plastic film to have a set of fine holes which provide a desired image as a whole and extruding ink through the holes, when a relatively less fluidal ink such as an emulsion ink having the "minute value" by spread meter less than "32" is used as proposed in Japanese Patent Publication 54-23601, a relatively thick layer of ink may be provided on a perforated thermal stencil sheet with an ink impermeable sheet being attached thereon, and a large number of prints are obtained by such an assembly of the thermal stencil sheet, the ink layer and the ink impermeable sheet being placed on each printing paper and a printing pressure being applied on the ink impermeable sheet with no supplement of ink between each two successive printings.

As a means suitable for practicing such a stencil printing method a thermal stencil sheet assembly comprising an annular frame made of a cardboard, a thermal stencil sheet laid over a first face of said frame and fixed thereto along an entire peripheral portion thereof, and an ink impermeable sheet laid over a second face opposite to said first face of said frame and fixed thereto at a part of an entire peripheral portion thereof has been proposed in Japanese Utility Model Publication 51-132007, and as a means suitable for conducting the stencil printing by employing such a thermal stencil sheet assembly a stencil printing device has been proposed in Japanese Utility Model Publication 57-15814 and is widely used in recent years under a trademark "Printgocco" to print Christmas and new year cards or the like.

It is also known to use a stencil sheet assembly having an annular frame made of a cardboard and a thermal stencil sheet laid over a first face of said frame and fixed thereto along an entire peripheral portion thereof with no ink impermeable sheet to be laid over a second face opposite to said first face of said frame in such a manner that such an assembly is mounted to a stamp having an ink pad impregnated with ink so that the ink pad is applied to the stencil sheet through an opening of the annular frame and the stencil printing is performed in a stamping manner.

Traditionally, the perforation of a thermal stencil sheet has been done in such a manner that the thermal stencil sheet is placed on an original bearing an image formed of an ink or the like which is rich in an infrared rays absorbing material such as carbon or the like and is capable of generating heat by absorption of infrared rays so that its thermo-plastic film is brought into contact with the image bearing surface of the original and light beams rich in infrared rays are irradiated onto the original through the thermo-plastic film, thus the thermo-plastic film being molten by the heat generated at the image portions. However, in accordance with the developments of the word processors, particularly Japanese word processors, in recent years multi-points matrix typing heads for typing characters in the form of a set of fine points have been developed and come to be widely used, and in accordance therewith it has now become possible to directly perforate a thermal stencil sheet by a thermal multi-points matrix typing head, as proposed in Japanese Patent Laying-open Publication 54-33117.

When a thermal stencil sheet comprising a thermo-plastic film and a multi-perforation supporting sheet as Japanese paper or the like pasted together is directly perforated by such a thermal multi-points matrix typing head, it is desired that the typing head is brought into contact with the thermal stencil sheet from the side of its thermo-plastic film, while on the other hand, in printing, it is desired that the perforated stencil sheet is brought into contact with printing paper also on the side of its thermo-plastic film in order to obtain clear printing results. Therefore, it is desired that the configuration of characters or the like to be formed by the thermal multi-points matrix typing head in directly perforating the thermal stencil sheet is reversed relative to that to be printed in a mirror image relation. In view of this it has been proposed in Japanese Patent Laying-open Publication 60-13664 that in a typewriter employing a thermal multi-points matrix typing head the direction of shifting a carriage supporting the typing head is reversed when the perforation typing is performed for a thermal stencil sheet in contrast to a normal typing on a paper sheet.

It is however relatively difficult to mount a relatively thin and soft thermal stencil sheet around the platen normally used in a typewriter or a word processor for directly perforating it in such a typing device now equipped with the thermal multi-points matrix typing head. A conventional method generally adopted to meet with such a difficulty was to lay a thermal stencil sheet on a normal paper with some appropriate binding of the two sheets by paste or the like at several peripheral portions, if necessary, so that the thermal stencil sheet is mounted around the platen of the typewriter or the like under a reinforcement available by the normal paper. In this respect it has been proposed in Japanese Patent Laying-open Publication 63-56450 to provisionally lay a thermal stencil sheet and a paper one over the other as pasted together along its peripheral portion, while the reinforcing paper is provisionally formed with sewing machine carts along its peripheral edge so that the reinforcing paper can be readily removed along the sewing machine carts so as to leave an annular frame portion as bound with the thermal stencil sheet after the typing perforation has been finished. In this publication it has been further proposed that the thermal stencil sheet thus prepared to have perforations and to have an annular frame made of the paper for reinforcement is pasted to a first face of an annular frame made of a cardboard which is provided with an ink impermeable sheet on a second face opposite to said first face thereof so that there is thus obtained a thermal stencil sheet assembly such as proposed in the above-mentioned Japanese Utility Model Laying-open Publication 51-132007.

Since the thermal stencil sheet is relatively thin and soft, it is desirable that the thermal stencil sheet is combined with a reinforcing paper sheet which lies over the entire surface thereof and is pasted together along its entire peripheral portion as proposed in the above-mentioned Japanese Patent Laying-open Publication 63-56450 for the convenience of the thermal stencil sheet being mounted to or dismounted from a typewriter or a word processor for the thermal typing perforation and for the convenience of mounting the perforated thermal stencil sheet to the printing device. However, in this case it is necessary that the central portion of the reinforcing paper must be removed from the combination of the thermal stencil sheet and the reinforcing paper after the thermal typing perforation has been finished before it is mounted to the printing device.

In view of such inconvenience, as a result of experimental researches the inventors of the present application have confirmed that when a sheet material which is thin but relatively elastic is employed for an annular reinforcing frame attached along the peripheral portion of a thermal stencil sheet, such an originally annular thin reinforcing frame is sufficiently effective for improving the convenience of handling the thermal stencil sheet for mounting it to or dismounting it from a typewriter or a word processor and further for mounting it to a printing device. However, since such a thin annular frame does not substantially increase the thickness and the rigidity of a piece of thermal stencil sheet, manufacturing, packing in and out and general transportation handling of such a thin frame reinforced thermal stencil sheet are still not very convenient.

SUMMARY OF THE INVENTION

It is therefore the object of the present invention to provide a thermal stencil sheet assembly which needs no such a work of removing a part of the reinforcing material for the thermal stencil sheet in the process of preparing a perforated stencil sheet by directly perforating a thermal stencil sheet in a typing device equipped with a thermal typing head so that it is used in its original form having a reinforcement sufficient for easy handling thereof for mounting in a typing device, removing from the typing device and further mounting in a printing device, and even for handling thereof in manufacture, packing in and taking out of cartons, and still further for mounting thereof in the stencil device proposed in the above-mentioned Japanese Utility Model Application 51-114253 or the above-mentioned stamp type printing device having an ink pad, as it is available in the form of a thermal stencil sheet assembly as proposed in the above-mentioned Japanese Utility Model Application 50-51306.

According to the present invention, the above-mentioned is accomplished by a thermal stencil sheet assembly comprising an annular frame made of a cardboard, and a thermal stencil sheet laid over a first face of said frame and fixed thereto along an entire peripheral portion thereof, wherein said frame comprises a first and a second frame element, said thermal stencil sheet is fixed to a first face of said first frame element, and said first frame element and said second frame element are detachably and reattachably bound together by a detachable-reattachable adhesion between a layer of a sticky binding material provided on a first face of said second frame element and a slippery surface provided on a second face of said first frame element opposite to said first face thereof.

In the above-mentioned thermal stencil sheet assembly said thermal stencil sheet may comprise a thermoplastic film and a multi-perforation sheet pasted together, and said thermal stencil sheet may be fixed to said first face of said first frame element on the side of said thermo-plastic film.

Alternatively, in the above-mentioned thermal stencil sheet assembly said thermal stencil sheet may comprise a thermo plastic film and a multi-perforation sheet pasted together, and said thermal stencil sheet may be fixed to said first face of said first frame element on the side of said multi-perforation sheet.

Further, in the above-mentioned thermal stencil sheet assembly an ink pressing sheet made of an ink impermeable sheet may be laid over a second face of said second frame element opposite to said first face thereof and fixed thereto at a part of an entire peripheral portion thereof.

According to the above-mentioned construction of the thermal stencil sheet assembly the reinforcing element for improving the handling of thermal stencil sheet in mounting thereof into and dismounting thereof from a typing device and in mounting thereof to a printing device is provided originally in the form of an annular frame element as said first frame element, and still further such an originally annular frame element is originally provided in a condition integrally combined with said second annular frame element made of a cardboard for providing an annular frame for expanding the thermal stencil sheet and holding an ink layer in the process of printing so as to be substantially in the same construction as the conventional thermal stencil sheet assembly used for the thermal stencil printing depending upon the heat conduction from black images.

In the manufacture of the thermal stencil sheet assembly according to the present invention a sheet material for constructing said first frame element and a sheet material for constructing said second frame element may be prepared in a condition bound together by the detachable-reattachable adhesion between said layer of a sticky binding material and said slippery surface so that as if a unitary cardboard sheet were handled to manufacture the annular frame for the conventional thermal stencil sheet assembly. Further, since the thermal stencil sheet assembly according to the present invention maintains the condition that the thermal stencil sheet is expanded by a rigid frame made of said first and second frame elements bound together until said first frame element is separated from said second frame element by said slippery surface being detached from said layer of the sticky binding material, the thin and soft thermal stencil sheet can be handled with no inconvenience.

It is already well known and widely used to provide a layer of a sticky binding material beforehand on a surface of an article which is to be attached to another body at said surface and to cover the layer of the sticky binding material with a cover sheet having a slippery surface so that the cover sheet is detached from the layer of the sticky binding material to expose said layer to operate as a binding agent just before the article is attached to another body. The adhesion between such a layer of a sticky binding material and the slippery surface is, in spite of the fact that it is very easily detachable, provides a relatively high binding strength in the attached condition, and further even after the lapse of a substantial time from the detachment of the slippery surface from the layer of the sticky binding material a substantial sticky rebinding of the slippery surface to the layer of the sticky binding material is available when the slippery surface is again pressed onto the layer of the sticky binding material. A well known sticky binding material for such a purpose is acrylic binder. The slippery surface to detachably meet with such a sticky binding material is available by silicon surface coating. Such a detachableness and reattachableness between the layer of a sticky binding material and a slippery surface can be effectively utilized when it is applied to the connection between said first frame element fixed to the peripheral portion of the thermal stencil sheet and said second frame element made of a cardboard and having a rigid structure so that the two frame elements are originally bound together and they are readily separated from one another and again they are readily reassembled. Further, since the sticky binding material never transfers to the slippery surface when it is detached from the layer of the sticky binding material, there occurs no such problem that said first frame element adheres to the platen of a typing device when the thermal stencil sheet accompanying said first frame element is mounted around the platen. Still further, when the perforated thermal stencil sheet is reassembled with said second frame for the subsequent printing process by said first frame element fixed to the thermal stencil sheet being reattached at its slippery surface to the layer of the sticky binding material, if the reassembling process started from an edge portion thereof is found to have been not in a good alignment near an end opposite to the starting end because of a poor skill in such handling, the reassembling process of the thermal stencil sheet and said second frame element may be retried any times, in contrast to the case when such an assembly is made by employing an ordinary binding agent which allows only one time attachment process.

Thus, according to the present invention, a thermal stencil sheet assembly is obtained in such a manner that it accomplishes a first object of improving the convenience of handling a thin thermal stencil sheet for perforation in a typing device such as a word processor, a second object of making it possible to manufacture the thermal stencil sheet assembly so as to have a highly rigid reinforcing frame as originally combined thereto, and a third object of allowing a trial and error assemblage of the perforated stencil sheet and the reinforcing frame.

BRIEF DESCRIPTION OF THE DRAWINGS

In the accompanying drawings.

DESCRIPTION OF THE PREFERRED EMBODIMENTS

In the following the present invention will be described in more detail with respect to some preferred embodiments thereof with reference to the accompanying drawings.

Figure 1:
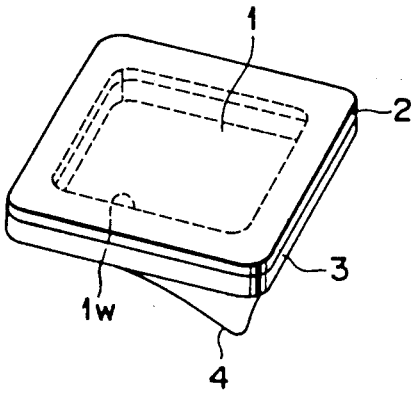
FIG. 1 is a somewhat diagrammatically perspective view of an embodiment of the thermal stencil sheet assembly according to the present invention in which the dimension of the thickness is exaggerated as compared with the plan dimension for the purpose of illustration.
Figure 2:
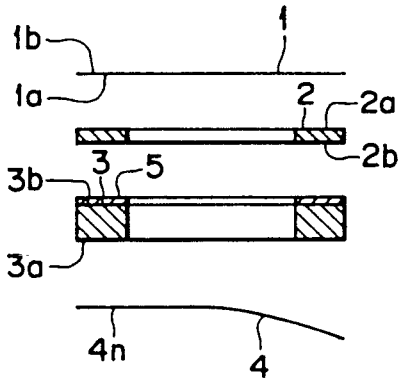
FIG. 2 is a sectional view of the thermal stencil sheet assembly shown in FIG. 1 showing the respective construction elements in a disassembled condition also with exaggeration of the thickness as compared with the plan dimension for the purpose of illustration.

Referring to FIGS. 1 and 2, 1 designates a thermal stencil sheet which is made of a thermo-plastic film of a copolymer of polyvinylidene chloride and vinyl chloride, polyethylene terephthalate, polypropyrene, etc. and applied with an expanding pretreatment and an ink permeable multi-perforation sheet such as Japanese paper, both being pasted together. In FIGS. 1 and 2, according to a first embodiment the thermo-plastic film forms a lower layer 1*a* and the multi-perforation sheet forms an upper layer 1*b*, while in a second embodiment the multi-perforation sheet forms the lower layer 1*a* and the thermo-plastic film forms the upper layer 1*b*.

2 and 3 designate a first and a second annular frame element of a same plan contour with one another, wherein said first frame element is made of a relatively thin sheet such as an ordinary paper and said second frame element is made of a relatively thick sheet such as a cardboard.

The thermal stencil sheet 1 is fixed along its entire peripheral portion to a first face 2*a* of the first frame element 2 by an adhesive. An ink pressing sheet 4 made of an ink impermeable sheet such as a vinyl chloride film is attached to a first face 3*a* of the second frame element 3 as fixed at a part 4*n* of its peripheral portion by an adhesive.

Figure 3:
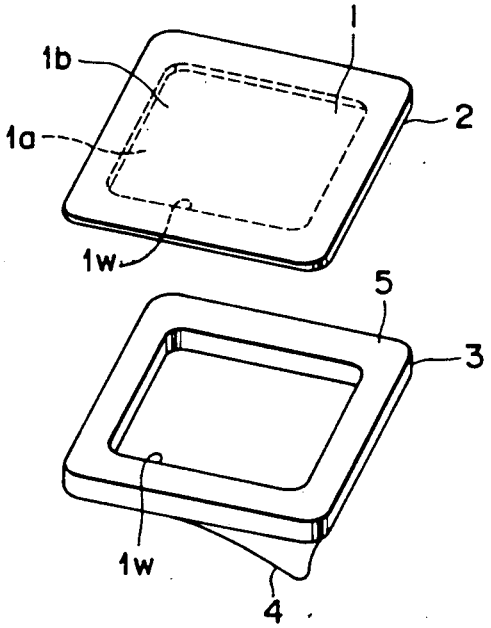
FIG. 3 is a perspective view of the thermal stencil sheet assembly shown in FIGS. 1 and 2 in a condition of temporal disassemblage for the perforation of the thermal stencil sheet.

A second face 3*b* opposite to said first face 3*a* of the second frame element 3 is provided with an annular layer 5 of a sticky binding material such as an acrylic sticky binder, which itself is commercially available, along its entire periphery. As opposed thereto a second face 2*b* opposite to the first face 2*a* of the first frame element 2 is formed to present a slippery surface which is attachable to and detachable from the layer 5 of the sticky binding material. The thermal stencil sheet assembly of the above-mentioned structure is shown in FIG. 3 in a condition that it is disassembled to a combination of the first frame element 2 and the thermal stencil sheet 1 on the one hand and a combination of the second frame element 3 and the ink pressing sheet 4 on the other hand. The layer 5 of the sticky binding material is firmly held on the face 3*b* of the second frame element 3 so that when the slippery face 2*b* of the first frame element 2 has been detached from the layer 5 of the sticky binding material, the sticky binding material of the layer 5 is completely retained on the second frame element 3 while the slippery face 2*b* of the first frame element 2 is completely free of any sticky binding material.

Figure 4:
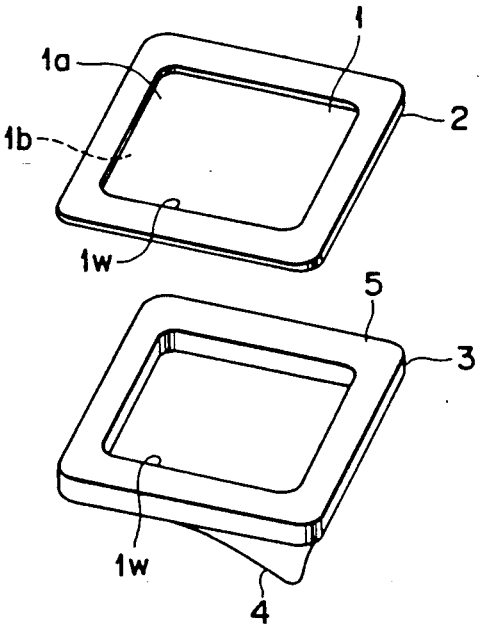
FIG. 4 is a perspective view showing a manner of reassemblage of the thermal stencil sheet assembly after the perforation according to one embodiment.

Thus the thermal stencil sheet 1 is available as reinforced at its peripheral portion as supported by the first frame element 2 so as to be easily mounted to a typing device such as a typewriter or a word processor together with the thermal stencil sheet 1 to receive direct perforation by a thermal typing head. According to the first embodiment wherein the lower layer 1*a* as viewed in FIG. 2 is a thermo-plastic film and the upper layer 1*b* is a multi-perforation sheet, after the perforation of the thermal stencil sheet 1 it is turned over relative to the second frame element 3 as shown in FIG. 4 so that the thermo-plastic film faces upward in the figure in the thermal stencil sheet 1 away from the second frame element 3 and the combination of the thermal stencil sheet 1 and the first frame element 2 is bound with the combination of the second frame element 3 and the ink pressing sheet 4 by the multi-perforation sheet being pressed against the layer 5 of the sticky binding material. In this case, since the binding between the layer 5 of the sticky binding material and the multi-perforation sheet such as Japanese paper is generally not readily detachable when once firmly compressed, the assemblage of the combination of the thermal stencil sheet 1 and the first frame element 2 and the combination of the second frame element 3 and the ink pressing sheet 4 should be carefully done so that no misalignment between the two combinations is noted only after the binding between the two combinations has come to finally binding.

On the other hand, according to the second embodiment in which the lower layer 1*a* as viewed in FIG. 2 is the multi-perforation sheet such as Japanese paper and the upper layer 1*b* is a thermo-plastic film, the combination of the thermal stencil sheet 1 and the first frame element 2 is, after the perforation of the thermal stencil sheet 1, again assembled to the combination of the second frame element 3 and the ink pressing sheet 4 in the same manner as originally provided with the slippery face 2*b* of the first frame element 2 being in contact with the layer 5 of the sticky binding agent. In this case, since the binding between the slippery face 2*b* and the layer 5 of the sticky binding agent is readily detachable and reattachable, the assemblage of the two combinations may be done in a trial and error manner in several times of repetition until a desired alignment between the two combinations is finally obtained.

Figure 5:
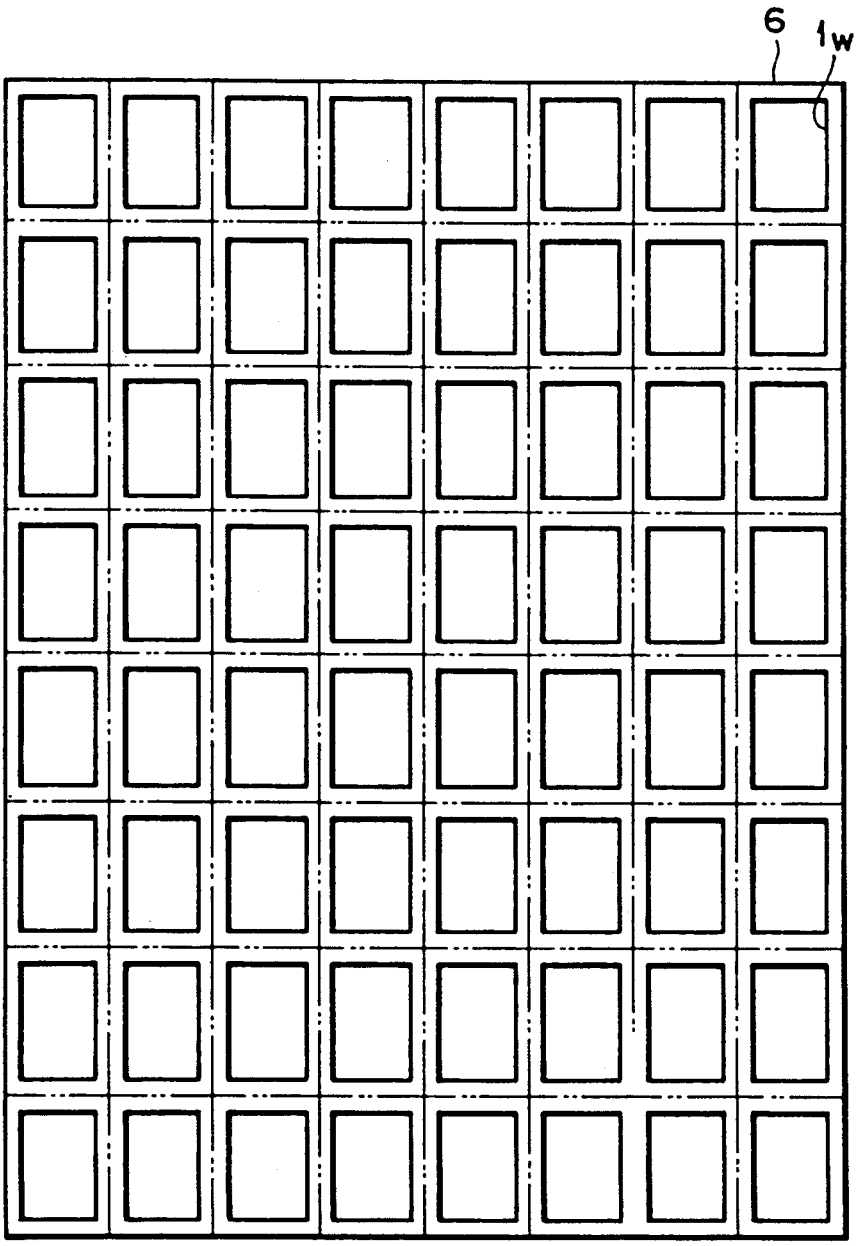
FIG. 5 is a plan view of an example of a semiproduct in a process of manufacturing the thermal stencil sheet assembly shown in FIGS. 1–3.

FIG. 5 is a plan view showing a sheet material in the process of manufacture of the thermal stencil sheet assembly shown in FIGS. 1–3. In FIG. 5 the sheet material 6 has a structure that a relatively thick sheet material such as a cardboard to form the second frame element 3 is provided with the layer 5 of a sticky binding material on a surface thereof and a relatively thin sheet material having a slippery surface to form the first frame element 2 is placed on the layer 5 of the sticky binding material with its periphery surface being in contact with the layer 5 of the sticky binding material, such a multi-layered sheet material having been formed into a lattice structure having longitudinal and lateral strip portions by windows 1*w* being punched out therefrom. By the sheet materials to form the first and second frame elements being bound together by the detachable-reattachable adhesion between the layer of a sticky binding material and the slippery surface prior to the punching out of the individual frame portions, in the lattice structure after the punching out of the windows the relatively thin sheet material to form the first frame element 2 is maintained in a stable condition as supported on the lattice structure of the relatively thick sheet material to form the second frame element 3. After the windows 1*w* have been punched out, the longitudinal and lateral strip portions in the lattice configuration of the sheet material to form the first frame element 2 are applied with paste and a thermal stencil sheet is placed thereon in a condition expanded in longitudinal and lateral directions to a certain required degree. In this manner the relatively thin sheet material in the form of the lattice with the windows 1*w* being already punched out to form the first frame element 2 can stably support the thermal stencil sheet in an expanded condition.

After the thermal stencil sheet has been fixed to the lattice supporting structure as shown in FIG. 5, the overall sheet material is cut along the chain lines shown in FIG. 5 in longitudinal and lateral directions. Then immediately the stencil sheet assemblies shown in FIGS. 1–3 except the ink pressing sheets 4 are obtained. The ink pressing sheet 4 may be attached after each stencil sheet assembly was cut out as described above. Alternatively, at the same time or before or after the thermal stencil sheet is attached to the lattice frame body as described above an ink impermeable sheet may be totally attached to another face of the lattice frame body opposite to the face to which the thermal stencil sheet is attached with supply of paste at necessary portions on the lattice frame body so that the thermal stencil sheet assemblies each having the thermal stencil sheet on one face and the ink pressing sheet on the other face are immediately obtained when the thus prepared overall sheet body is cut longitudinally and laterally along the chain lines shown in FIG. 5.

Thus it will be understood that according to the present invention there is obtained such a thermal stencil sheet assembly that can be handled as a unitary body similar to the conventional thermal stencil sheet assembly of this type all through the processes of manufacture, packing in the cartons and transportation to the users and is easily separable to two frame bodies when the thermal stencil sheet is perforated in a typing device such as a typewriter or a word processor equipped with a thermal typing head and then after the perforation is easily reassembled to the thermal stencil sheet assembly suitable for the printing process by the convenient stencil printing device as proposed in the above-mentioned Japanese Utility Model Publication 57-15814, with a further convenience that the reassemblage can be more easily performed to allow repetitive trials until a desired alignment between the two frame members is obtained when they are reassembled with the slippery face of the first frame element being attached to the layer of the sticky binding material as in the above-mentioned second embodiment.

Although the invention has been illustrated and described in detail with respect to some preferred embodiments thereof, it will be understood by those skilled in the art that various modifications are possible with respect to these embodiments without departing from the spirit of the present invention.

We claim:

1. A thermal stencil sheet assembly comprising an annular frame made of a cardboard, said annular frame comprising first and second frame elements, each of said first and second frame elements having oppositely disposed first and second faces;

a thermal stencil sheet laid over said first face of said first frame element and fixed thereto along the entire peripheral portion thereof;

a detachable-reattachable adhesion means for detachably and reattachably bonding said first frame element and said second frame element together;

said adhesion means comprising a layer of sticky binding material provided on said first face of said second frame element and a slippery surface provided on said second face of said first frame element.

2. A thermal stencil sheet assembly according to claim 1, wherein said thermal stencil sheet comprises a thermo-plastic film and a multi-perforation sheet pasted together, and said thermal stencil sheet is fixed to said first face of said first frame element along the sides of said thermo-plastic film.

3. A thermal stencil sheet assembly according to claim 1, wherein said thermal stencil sheet comprises a thermo plastic film and a multi-perforation sheet pasted together, and said thermal stencil sheet is fixed to said first face of said first frame element along the sides of said multi-perforation sheet.

4. A thermal stencil sheet assembly according to claim 1, wherein an ink pressing sheet made of an ink impermeable sheet is laid over a second face of said second frame element opposite to said first face thereof and fixed thereto along a part of the peripheral portion thereof.

* * * * *